US012570421B2

(12) United States Patent
Degli Esposti et al.

(10) Patent No.: US 12,570,421 B2
(45) Date of Patent: Mar. 10, 2026

(54) METHOD TO SET UP A MOVABLE OPERATING MEMBER OF AN AUTOMATIC MACHINE FOR MANUFACTURING OR PACKAGING CONSUMER ARTICLES

(71) Applicant: G.D SOCIETA' PER AZIONI, Bologna (IT)

(72) Inventors: Matteo Degli Esposti, Bologna (IT); Luca Carboni, Bologna (IT); Maurizio Zanotti, Grizzana (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 205 days.

(21) Appl. No.: 18/280,973

(22) PCT Filed: Mar. 9, 2022

(86) PCT No.: PCT/IB2022/052089
§ 371 (c)(1),
(2) Date: Sep. 8, 2023

(87) PCT Pub. No.: WO2022/189990
PCT Pub. Date: Sep. 15, 2022

(65) Prior Publication Data

US 2024/0067375 A1 Feb. 29, 2024

(30) Foreign Application Priority Data

Mar. 9, 2021 (IT) ..... 102021000005468

(51) Int. Cl.
*B65B 19/30* (2006.01)
*B65B 51/10* (2006.01)
*B65B 57/08* (2006.01)

(52) U.S. Cl.
CPC ..... *B65B 19/30* (2013.01); *B65B 51/10* (2013.01); *B65B 57/08* (2013.01)

(58) Field of Classification Search
None
See application file for complete search history.

(56) References Cited

U.S. PATENT DOCUMENTS 4,712,357 A 12/1987 Crawford et al.
5,479,354 A 12/1995 Husslein
(Continued)

FOREIGN PATENT DOCUMENTS

DE 2938095 A1 4/1981
DE 3621556 A1 4/1987
(Continued)

OTHER PUBLICATIONS

European Patent Application No. 22715167.7, Communication Pursuant to Rule 114(2) EPC, dated Nov. 27, 2023.
(Continued)

*Primary Examiner* — Tanzim Imam
(74) *Attorney, Agent, or Firm* — MARSHALL, GERSTEIN & BORUN LLP

(57) ABSTRACT

A method to set up at least one movable operating member (5, 7) of an automatic machine (1) for manufacturing consumer articles (3) comprising the steps (16, 17) of: defining a first motion profile (FP) of the movable operating member (5, 7), determining possible imperfections in the processing of the articles (3), defining a corresponding second motion profile (SP) of an electric actuator system (8, 9), which, through a motion transmission system (12), is mechanically connected to the movable operating member (5, 7) and moves the movable operating member (5, 7) with the first motion profile (FP), correcting, by means of an interface device (15) of the automatic machine (1) and based on the
(Continued)

possible determined imperfections, at least one conversion parameter (50) concerning the processing on the articles (3) performed by the movable operating member (5, 7); processing the first motion profile (FP), thus obtaining a first modified profile (MFP) of the movable operating member (5, 7).

20 Claims, 6 Drawing Sheets

(56) References Cited

U.S. PATENT DOCUMENTS

| | | | |
|---|---|---|---|
| 6,612,093 | B1 | 9/2003 | Grossmann et al. |
| 7,055,296 | B2 | 6/2006 | Christ |
| 8,155,781 | B2 | 4/2012 | Birzer et al. |
| 10,882,652 | B2 | 1/2021 | Lutz et al. |
| 12,078,983 | B2 | 9/2024 | Lang et al. |
| 2009/0044491 | A1* | 2/2009 | De Pietra ..... B65B 57/00 53/507 |
| 2012/0187889 | A1 | 7/2012 | Krauskopf et al. |
| 2014/0223863 | A1 | 8/2014 | Lancaster, III et al. |

FOREIGN PATENT DOCUMENTS

| | | | | |
|---|---|---|---|---|
| DE | 4041869 | A1 | | 7/1992 |
| DE | 10164496 | A1 | | 7/2003 |
| DE | 102008003549 | A1 | | 7/2009 |
| DE | 102009023475 | A1 | | 12/2010 |
| DE | 102014212528 | A1 | | 12/2015 |
| DE | 102016208670 | A1 | | 11/2017 |
| EP | 0879795 | A2 | | 11/1998 |
| JP | H09301327 | A | | 11/1997 |
| JP | H1179117 | A | * | 3/1999 |
| JP | 2014237465 | A | | 12/2014 |
| WO | WO-2004065223 | A1 | | 8/2004 |
| WO | WO-2020/240503 | A1 | | 12/2020 |
| WO | WO-2020259730 | A1 | | 12/2020 |

OTHER PUBLICATIONS

International Application No. PCT/IB2022/052089, International Search Report and Written Opinion, mailed May 30, 2022.

"SIMATIC im lauf der geschichte" [SIMATIC throughout history], Siemens, accessed online <https://www.siemens.com/de/de/unternehmen/konzern/geschichte/specials/60-jahre-simatic.html> (2012).

"Ausbildungsunterlage fur die durchgangige Automatisierungslosung Totally Integrated Automation (TIA), Modul 0, Guide fur die Ausbildungsunterlage", Siemens (2010).

Third Party Observations (Communication Pursuant to Rule 114(2) EPC), in European Patent Application No. 22715167.7, mailed May 16, 2025.

* cited by examiner

METHOD TO SET UP A MOVABLE OPERATING MEMBER OF AN AUTOMATIC MACHINE FOR MANUFACTURING OR PACKAGING CONSUMER ARTICLES

CROSS-REFERENCE TO RELATED APPLICATIONS

This patent application is a U.S. national stage of International Application No. PCT/IB2022/052089, filed Mar. 9, 2022, which claims priority of Italian Patent Application No. 102021000005468 filed on Mar. 9, 2021, the entire disclosure of which is incorporated herein by reference.

TECHNICAL FIELD

The present invention relates to a method to set up a movable operating member of an automatic machine for manufacturing or packaging consumer articles.

The present invention finds advantageous but not limiting application in an automatic packaging machine that manufactures packets of cigarettes and in the control method thereof, to which the following disclosure will make explicit reference without thereby losing generality.

PRIOR ART

An automatic packaging machine comprises a plurality of movable operating members which act on consumer articles (for example packets of cigarettes, food products, sanitary absorbent articles, etc.) to modify conformation, structure or position thereof. Generally, the movable operating members are mechanical parts of different shapes and sizes designed to process the consumer articles and are, in most cases, actuated by electric motors or pneumatic cylinders.

During the start-up of the automatic machine, due to the different assembly methods and the normal machining tolerances of the mechanical parts, it is often necessary, in order to obtain a high machining precision, to set up the movable operating members; namely, it is necessary to carry out calibration, filing, shimming and synchronization operations, which are necessary for the correct operation of the automatic machine. In the absence of this set up, in most cases, the product does not fall within the precision or quality specifications required by the customer, as the motion profile of the movable operating member does not accurately correspond to the one processed during the design stage of the automatic machine.

To date, these operations are carried out by expert technicians directly on site. These technicians insert shims and/or modify parts (by means of file, milling, cutting) in order to allow the movable operating member (namely, the last follower) to carry out the required processing with the desired precision.

The poor repeatability of these operations (each automatic machine is modified ad hoc according to the assembly and/or structural defects of the available parts) determines a non-calculable and difficult to record difference between automatic machines, or parts thereof, which should be identical.

Furthermore, the parts on which said technicians work, are usually mechanical parts (in particular portions of kinematic elements), since the main coordination procedure of the different motors belonging to an automatic machine has been, up to recent times, purely mechanical.

In addition, also due to the mechanical nature of the processed parts, these set up activities are rarely recorded and/or shared, thus causing a significant waste of time in understanding subsequent failures and in providing after-sales support to customers who purchase these automatic machines, as well as high difficulties in the mass production of identical machines.

Finally, the aforementioned technicians, although experts in assembly and set up, do not usually have the kinematic skills necessary to adjust the operating members according to their respective motion profiles, limiting their considerations according to the product and the desired movement thereof (namely, the effect of the aforementioned motion profiles). Therefore, in order to achieve set-up, these operators modify the motion profiles of the movable operating members in an empirical way, performing a large number of attempts before reaching the desired behaviour of the movable operating member. All this leads to an extension of the delivery times of the automatic machine.

DESCRIPTION OF THE INVENTION

The object of the present invention is to provide a method to set up a movable operating member of an automatic machine for manufacturing or packaging consumer articles, which is at least partially free from the drawbacks described above and, at the same time, is simple and inexpensive to obtain.

According to the present invention, a method is provided to set up a movable operating member of an automatic machine for manufacturing or packaging consumer articles according to what is claimed in the attached claims. A machine designed to implement the above method is also provided.

The claims describe preferred embodiments of the present invention forming an integral part of the present description.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 1:
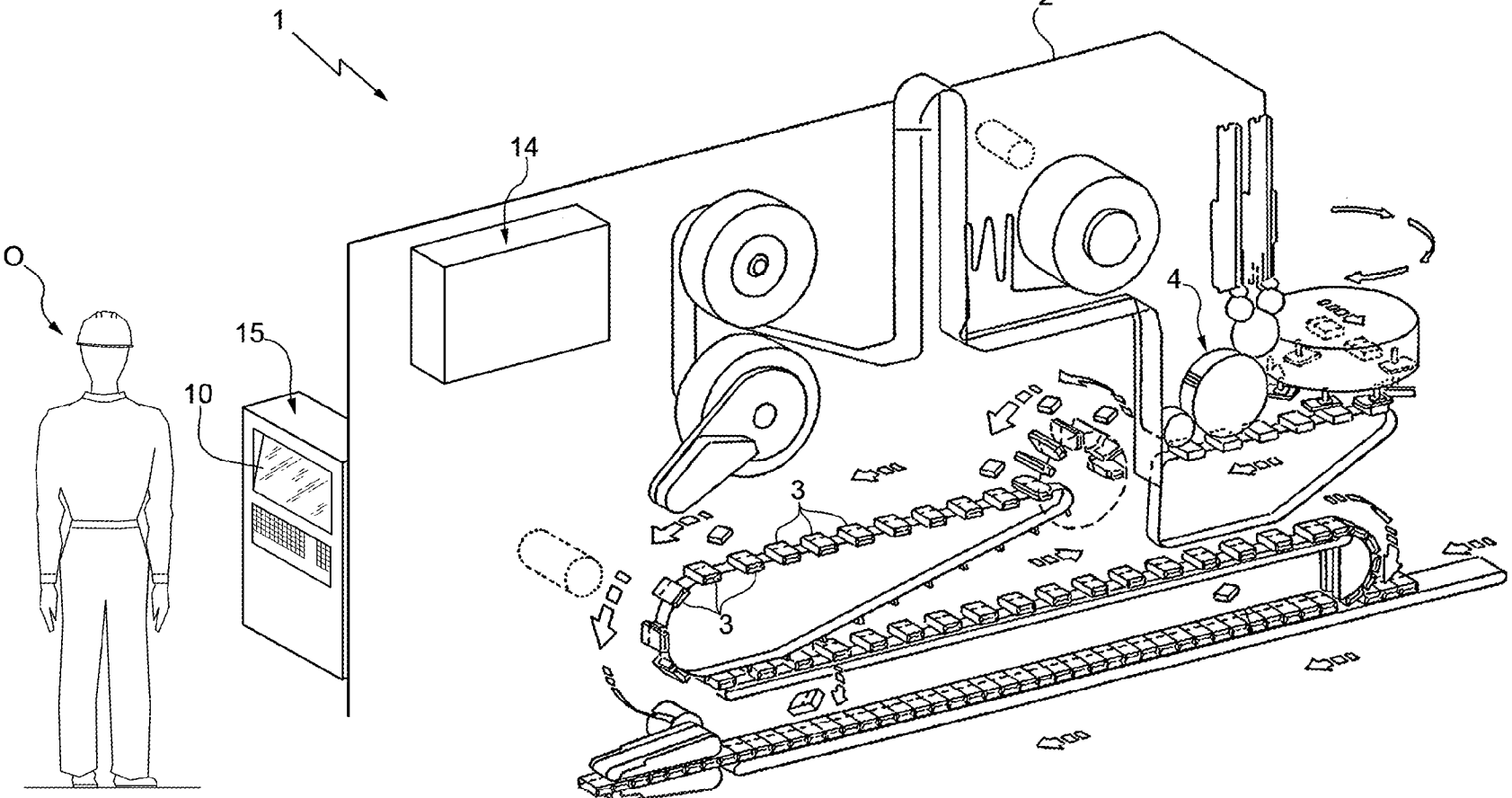
FIG. 1 is a perspective and schematic view of an automatic packaging machine for manufacturing packages.

FIG. 1 illustrates an automatic machine 1 for manufacturing consumer articles, preferably of the tobacco industry, in particular an automatic packaging machine 1 for applying a transparent overwrap to packets of cigarettes.

The automatic machine 1 comprises a base 2 on which a plurality of movable operating members are mounted (such as, for example, grippers, drums, pushers, counter-pushers, jumpers etc.), which carry out operations for manufacturing and/or packaging consumer articles (which in the non-limiting embodiment illustrated in FIG. 1 are packets 3 of cigarettes). As indicated above, the movable operating members are mechanical parts of different shapes and sizes designed to process the consumer articles and are, in most cases, actuated by electric motors or pneumatic cylinders.

In particular, the automatic machine 1 comprises a wrapping unit 4 provided with a plurality of movable operating members, each of which is moved by a respective electric motor (or by any type of actuator device).

Figure 2:
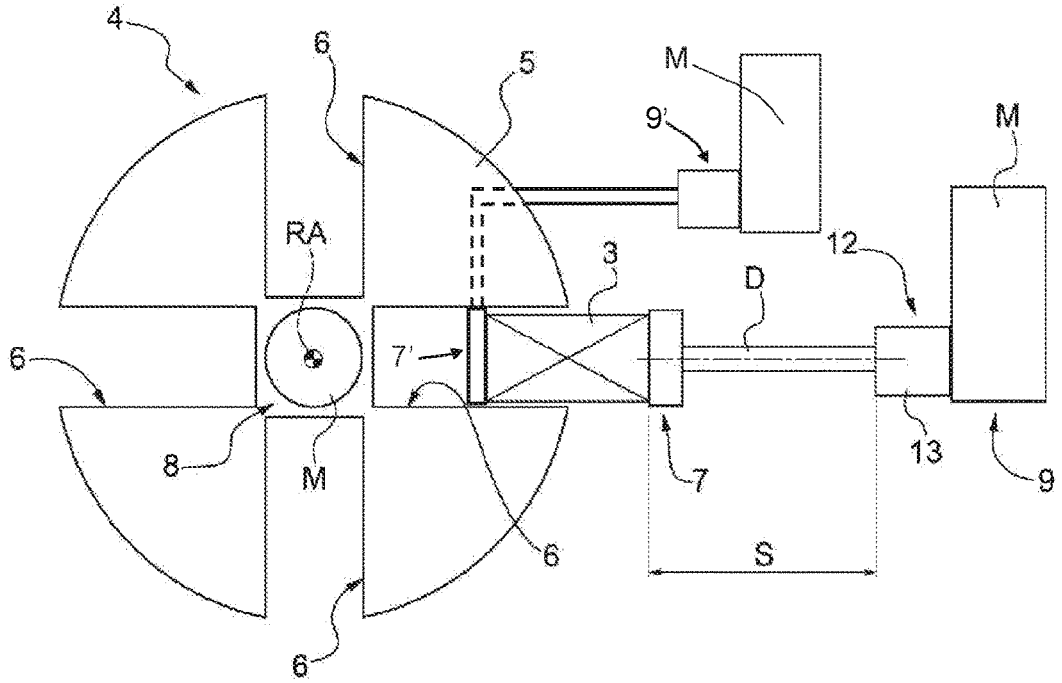
FIG. 2 is a schematic side view of part of the automatic machine of FIG. 1 where two movable operating members in a first configuration and a possible additional movable member are provided.
Figure 3:
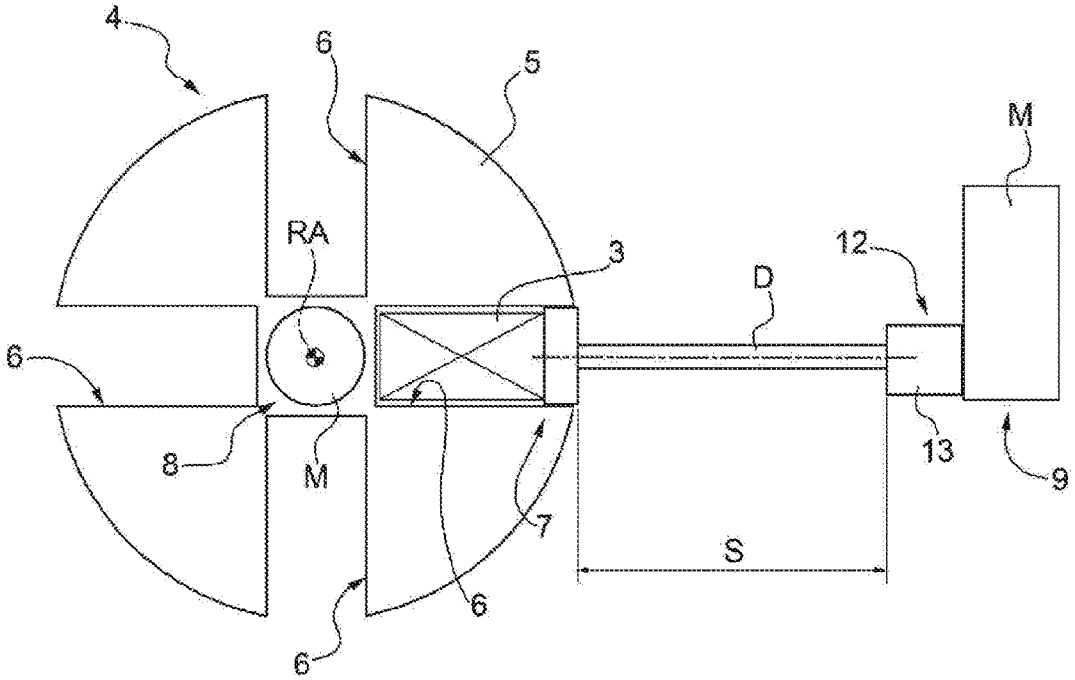
FIG. 3 is a schematic side view of the part of FIG. 2 in a second configuration.

In the non-limiting embodiment of FIGS. 2 and 3, the wrapping unit 4 comprises two movable operating members: a movable wheel 5 mounted rotatable around a central rotation axis RA and provided with seats 6 (in particular pockets), designed to receive the packets 3 of cigarettes, and a pusher 7 designed to push the packets 3 of cigarettes inside the seats 6 of the movable wheel 5.

In the non-limiting embodiment of FIG. 2, the wrapping unit 4 comprises a further movable operating member: a counter-pusher 7' designed to accompany, together with the pusher 7, the packets 3 of cigarettes inside the seats 6 of the movable wheel 5. In particular, the counter-pusher 7' is configured to partially compress the packet 3 of cigarettes to be accompanied in order to allow a safe and firm grip between the pusher 7 and the counter-pusher 7'.

Therefore, the movable wheel 5, the pusher 7 and the counter-pusher 7' are movable operating members, since they carry out processing (movements) on the packets 3. In some non-limiting examples, other movable operating members are sealing arms, for example to close the outer wrap (usually made of cellophane) of the packet 3 of cigarettes.

In the non-limiting embodiment illustrated in FIGS. 2 and 3, the wrapping unit 4 of the automatic machine 1 also comprises electric actuator systems 8, 9 and 9'. In particular, the electric actuator systems 8, 9 and 9' are electric motors M. The electric actuator system 8 is coupled to the wheel 5 to carry out the rotation of the wheel 5 around the rotation axis RA and is connected to a static power converter (known and not illustrated) which controls the electric actuator system 8 so as to set in rotation the wheel 5 (with the interposition of a reducer not illustrated). The electric actuator system 9 is coupled to the pusher 7 to move the pusher 7 in a linear manner along a direction D and for a predefined stroke S (FIGS. 2 and 3) and is connected to a further static power converter (known and not illustrated) which controls the electric actuator system 9. The electric actuator system 9' is coupled to the counter-pusher 7' to compress and accompany the packet 3 of cigarettes, in a linear manner, along a direction D and for a predefined stroke S (FIGS. 2 and 3) and is connected to a further static power converter (known and not illustrated) which controls the electric actuator system 9'.

In particular, the electric actuator systems 8, 9 and 9' are connected to the movable operating members, namely, to the wheel 5, to the pusher 7 and to the counter-pusher 7' with the interposition of a motion transmission system 12 (for example, as in the case of the pusher 7, a reducer 13 connected to a screw or an articulated quadrilateral which transforms the circular motion into linear motion, or, as in the case of the wheel 5, a reducer, for example epicyclic, which frees the wheel 5 from moving at exactly the same speed as the motor M).

In some non-limiting and not illustrated cases, the motion transmission system 12 is any device capable of transmitting the movement of the electrical actuator systems 8, 9 and 9' to the respective movable operating members (in the embodiment of FIGS. 2 and 3: wheel 5, pusher 7 and counter-pusher), for example: a mechanical cam, a rack, a crank mechanism, a kinematic chain, a parallelogram . . . .

According to some preferred but not limiting embodiments, the electric actuator systems 8, 9 and 9' are asynchronous electric motors. In particular, the static power converters are actuators that control, on the basis of the desired method, the amount of current to be supplied to the respective electric actuator systems 8, 9 and 9' and therefore control the electric motors M.

The automatic machine 1 comprises, furthermore, a control unit 14 (FIG. 1), which is configured to control at least the electric actuator systems 8, 9 and 9'.

Advantageously, the automatic machine 1 comprises an interface device 15 (illustrated in FIG. 1) configured to allow an operator O to modify the motion of the movable operating members (for example, of the wheel 5, of the pusher 7, of the counter-pusher 7' or of a sealing element). In particular, the interface device 15 comprises a screen 10; more precisely, the screen 10 is a touch screen.

In the non-limiting case of FIG. 2, the stroke S of the pusher 7 is not sufficient to perfectly insert the packet 3 inside the seat 6 (in FIG. 2 the stroke S is considerably insufficient by way of example; it should be noted that said insufficiency may be even of the order of a tenth of a millimetre). A further non-limiting example is represented by the case in which the pusher 7 and counter-pusher 7' are more distant from one another than the length of the packet 3. In use, these situations, especially at high production speeds, involve a possible loss of the packet 3 and/or a possible damage to packet 3 itself. The reduced stroke S or the absence of compression of the packet 3 may be due to multiple factors, such as an incorrect assembly of one of the parts of the wrapping unit 4 (the pusher 7, the counter-pusher 7', the wheel 5, the motors M, a rod or a piston of the pusher or of the counter-pusher, etc.) or an incorrect processing of said parts or the use of off-specification materials used in the packaging (when slightly oversized materials are provided, which the machine must still be able to process). In this case, the operator O, in order to speed up the set-up of the pusher 7, instead of inserting (fixing and/or sealing) a shim to bring the packet 3 completely inside the pocket 6 and instead of calling on an engineer designer to change the motion process of the pusher 7, interacts with the interface device 15 in order to vary a conversion parameter 50 (illustrated for example in the non-limiting embodiments of FIGS. 7 and 8). Indirectly, the conversion parameter 50 determines the variation of the motion profile of the motor M which moves the pusher 7 and/or the counter-pusher 7'. In this way, in the case of an insufficient stroke S, once the conversion parameter 50 (and therefore the motion profile) has been changed by means of the interface device 15, the stroke S will be such as to allow the complete entry of the packet 3 into the pocket 6, as illustrated in FIG. 3. In this way, in the case of insufficient compression of the packet 3 (as in the case of FIG. 7), once the conversion parameter 50 (and therefore the motion profile) has been changed, for example by increasing the compression by 1.5 mm by means of the interface device 15, the movement of the counter-pusher will start from a higher initial (counter-pusher) height and will end sooner than expected in order to reduce the distance between the pusher 7 and the counter-pusher 7' when accompanying the packet 3 by exactly 1.5 mm. The adjustment made is spatial on the height, namely, the profile is moved up or down along the ordinate axis: in this case the adjustment is spatial on the slave quota.

In particular, the operator O will vary the motion profile of the motor M of the electric actuator system 9 by entering as a conversion parameter 50 an offset equal to the amount desired to increase the compression of the packet 3 or the stroke S of the pusher 7, all regardless of the motion transmission system 12.

Advantageously but not necessarily, the conversion parameter 50 is a parameter concerning the article to be produced (in this case the packets 3—and not to the motion of the motors M). In this way, the operator O is able, without the aid of technically expert personnel, to modify the behaviour of the automatic machine 1 by setting how the operator would like to modify the behaviour of the same on the article to be produced, rather than how the operator would like to modify the motion of the motors M. Therefore, the task of the operator O is simplified, since one can modify the motion profile of the motors M in a transparent way to the same, but referring exclusively to the conversion parameter 50, which defines an effect on the article to be processed. In other words, the conversion parameter 50 allows the operator O to set up the automatic machine by means of adjustments made at a higher conceptual level than the variation of the laws of motion of the individual motors M.

Advantageously but not necessarily, the conversion parameter 50 comprises a position of the article to be processed, its compression or a time or a force or a pressure of a given processing procedure.

In some non-limiting cases, the conversion parameter 50 comprises the format of article 3 being processed. In this way, the conversion parameter is used to scale parametric motion profiles (or families of motion profiles) according to the format (geometries, types of material, etc.) of the article being processed.

In some non-limiting cases, the conversion parameter 50 does not concern the format of the article 3 being processed, but exclusively the properties of (or deriving from) the processing carried out on the same.

Obviously, what has been described is also intended for cases other than the one mentioned wherein, in any case, the motion of a movable operating member is corrected by an operator O by means of the interface device 15, operating at the level of the movable operating member and not of the actuator system, correcting a respective conversion parameter 50. By way of example, other cases could be: an excessive stroke S that compresses the packet 3 inside the seat 6, an imprecise rotation of the wheel, a sealing time, etc.

Figure 4:
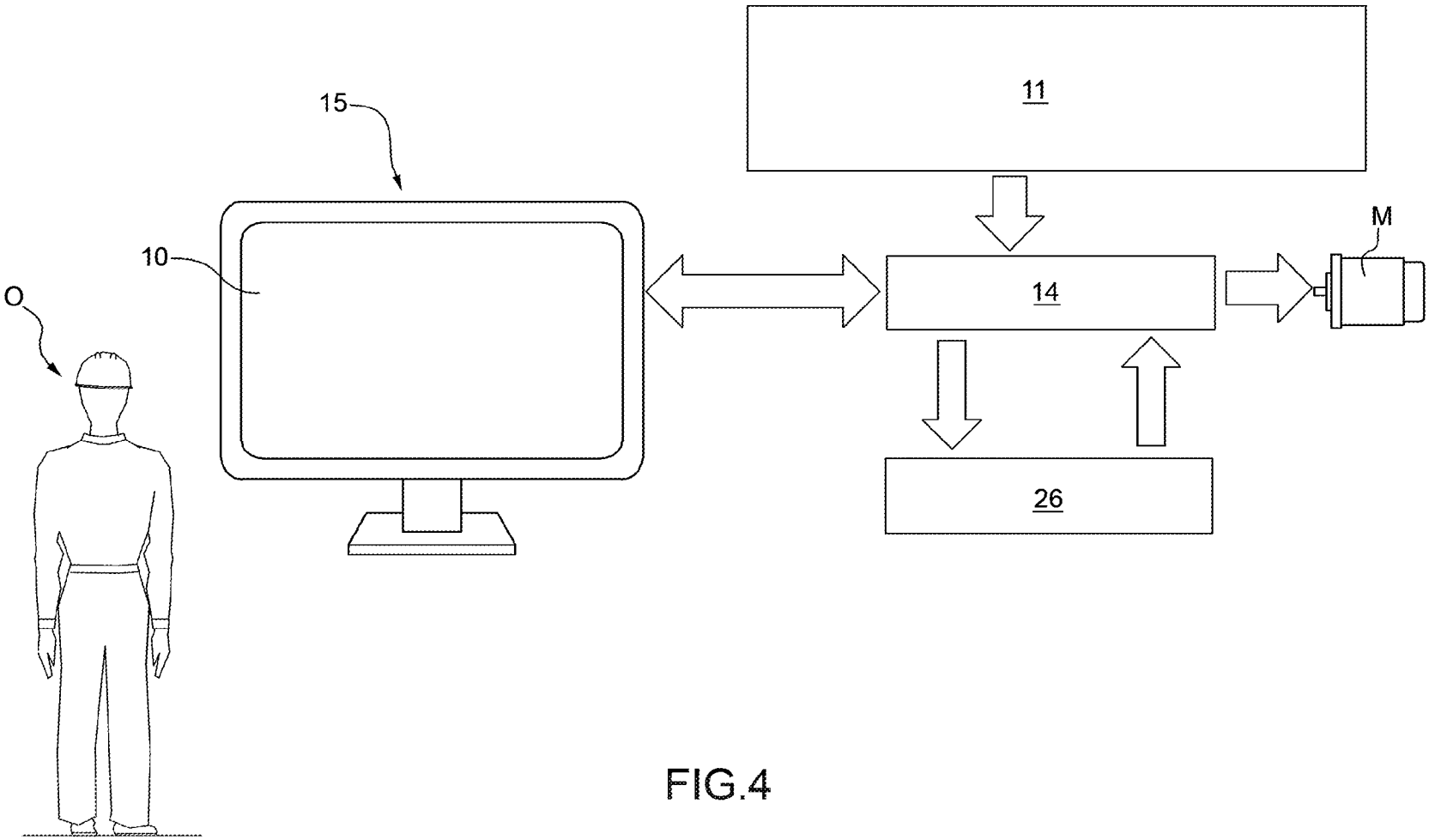
FIG. 4 schematically illustrates the structure and connection of some parts of the machine of FIG. 1.

According to the non-limiting embodiment of FIG. 4, the control unit 14 is connected to the interface device 15, so as to allow the operator O to interact with the control unit 14. In particular, the control unit 14 comprises (or is connected to) a memory unit 11, inside which are saved the motion profiles that the movable operating members of the automatic machine 1, in use, will perform and/or their relationship with the respective conversion parameters 50 which can be set by the interface device 15.

Advantageously but not necessarily, the automatic machine 1 comprises a calculation unit 26, connected to the control unit 14 and configured to calculate the modified motion profiles on the basis of the modifications imparted by the operator O (to the conversion parameter 50) by means of the interface device 15. In particular, the profiles modified according to the variation of the conversion parameter 50 will then be commanded to the motors M of the automatic machine by means of the control unit 14.

Figure 5:
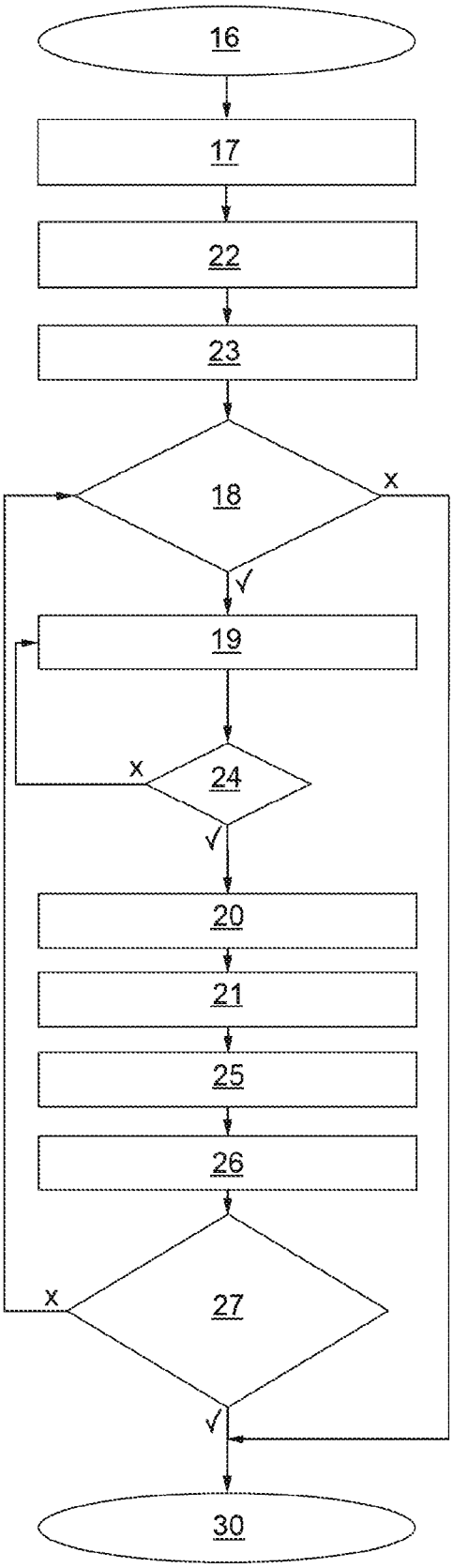
FIG. 5 illustrates a possible flow diagram concerning the general steps of the method and how they can be connected to each other.

FIG. 5 illustrates a flow chart which represents a non-limiting embodiment of the method according to the present invention.

In the flow diagram of FIG. 5 the convention has been used according to which the oval blocks indicate the beginning or the end of the diagram, the rectangular ones indicate a generic instruction and the rhomboid blocks, placed at a branch, are choice blocks, containing a logical condition that determines which direction the flow will take. In particular, at the choice blocks, the flow of the diagram branches off in the direction marked by the check symbol "✓" if the logical condition is satisfied, otherwise, if this condition is not satisfied, the flow branches off into the direction marked by the symbol "X".

The method comprises a step 16 of defining a motion profile FP (illustrated in FIG. 6) of the movable operating member (for example of the pusher 7), by means of which at least one processing is performed on the articles (or on the packets 3). In particular, the step 16 is performed during the design of the automatic machine 1 and defines the specifications for the calculation of the profile FP implemented on the last follower (namely, on the movable operating member that is needed to move). Furthermore, the method comprises (preferably during the design phase) the step of correlating the first motion profile FP of the movable operating member 5, 7, 7' with at least one conversion parameter 50 concerning the processing on the articles 3 carried out by the movable operating member 5, 7.

In order to move the pusher with the desired motion profile, the method comprises the further step 17 of defining a motion profile SP of the electric actuator system 9, corresponding to the profile FP. In particular, the electric actuator system 9, through the motion transmission system 12, is mechanically connected to the movable operating member (namely, to the pusher 7) and moves the movable operating member with the motion profile FP. In other words, during the step 17, the motion profile SP is defined which the electric actuator system 9, namely, the electric motor M, must follow to make the pusher 7 move (namely, in this non-limiting case, the movable operating member, namely, the ultimate follower of the kinematic chain) with the profile FP.

Figure 6:
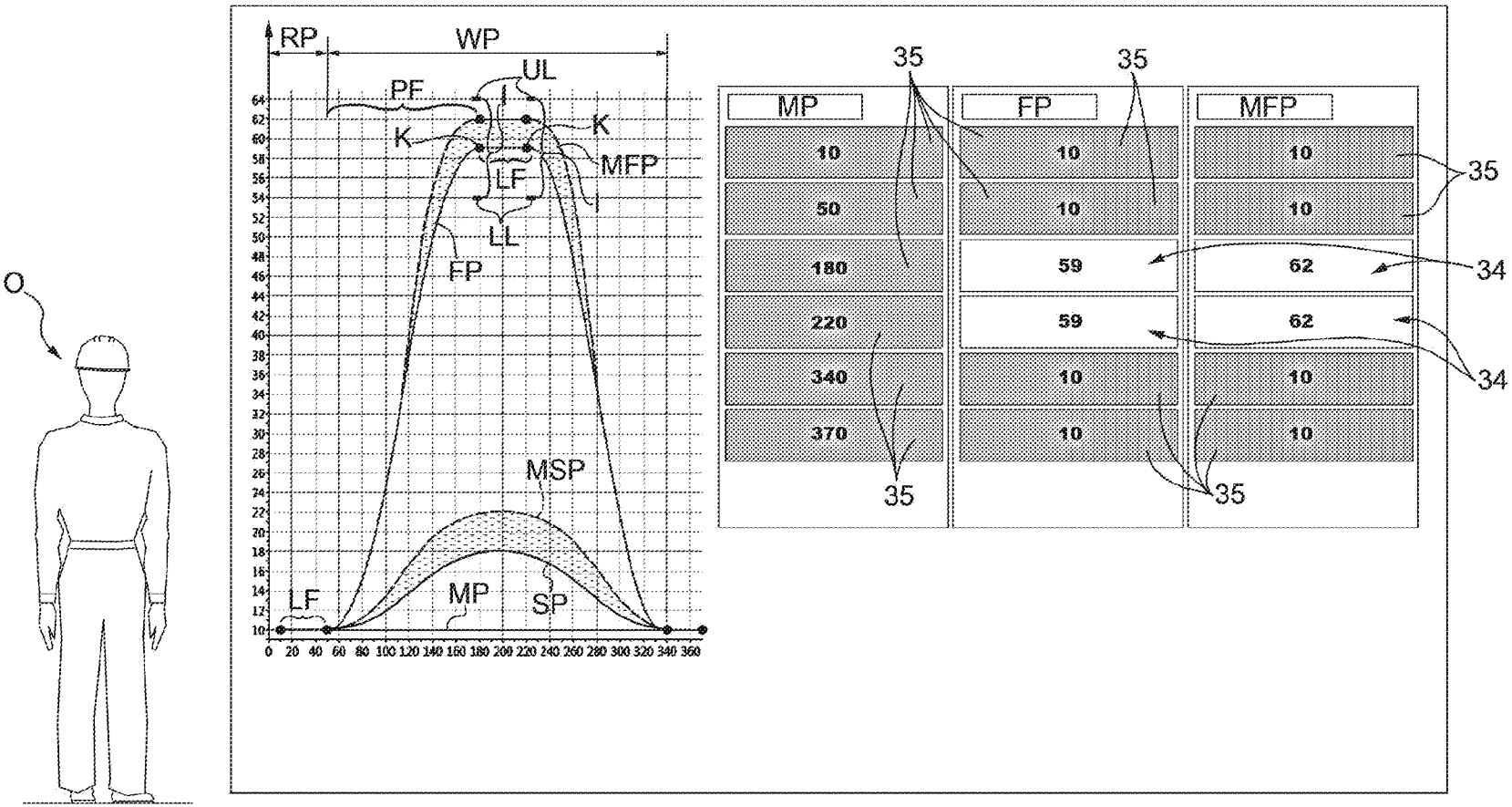
FIG. 6 schematically illustrates a possible screen display of an interface of the automatic machine concerning the part of FIGS. 2 and 3.

According to the non-limiting example illustrated in FIG. 6, the motion profile FP corresponds to the variation of the position of the pusher 7 along the stroke S of FIG. 2 (ordinate axis) relative to a reference point (abscissa axis), and the motion profile SP corresponds to the variation in position that the motor M of the electric actuator system 9 must carry out to move the pusher with the profile FP.

According to a non-limiting example such as the one illustrated in FIG. 6, the motion profile FP describes the movement of the pusher 7 of the wrapping unit of FIG. 2. In particular, this profile provides for an initial forward step, a central step at constant position and a final backward step.

Advantageously, the method also comprises a step 18 of determining possible imperfections in the processing of the articles (the packets 3) by the movable operating member (for example, the pusher 7). In other words, during this step, the correct operation of the movable operating member is checked. In the event that, during this step, no imperfections are found, the method concludes with step 30, in which the production of the packets 3 smoothly proceeds.

Advantageously, in the event that imperfections in the processing of the articles have been determined during the step 18, the method comprises the further step 19 of correcting the conversion parameter 50 (FIGS. 7 and 8), by means of the interface device 15 of the automatic machine 1 and based on the possible imperfections in the processing of the packets 3, without directly modifying the motion profile FP, but in any case so as to obtain a modified profile MFP (FIG. 6) of the movable operating member (namely, of the pusher 7). In this way, it is possible to focus on the conversion parameter 50 concerning the article 3 to be produced or packaged, rather than on the motion profile of the movable operating member and therefore, said task is independent from the knowledge of the mechanics of the motion transmission system 12.

According to the non-limiting embodiment of FIG. 5, the method comprises a step 20 of processing, by means of the control unit 14 and according to the correction of the conversion parameter 50, the first motion profile FP, thus obtaining a first modified profile MFP of the movable operating member 5, 7, 7'. Furthermore, said step provides for the consequent calculation, by means of the control unit 14, of a reverse kinematics of the modified profile MFP of the movable operating member (e.g., the pusher 7) so as to obtain a corresponding modified profile MSP to be commanded to the electric actuator system 9. In particular, the reverse kinematics is considered by calculating the interposition of the motion transmission system 12 (e.g., of the reducer 13). In this way, an operator, by making corrections on the motion profile FP of the pusher 7 (for example, as in the case of FIG. 2, by increasing the stroke of the pusher 7), actually makes corrections on the motion profile SP of the electric actuator system 9 (which, in use, actively moves the pusher 7).

Advantageously but not necessarily, the method comprises the further step 21 of modifying the control in order to control the electric actuator system 9 so as to carry out the corresponding modified profile MSP. In this way, the electric actuator system 9 moves, through the interposition of the motion transmission system 12, the pusher 7 with the desired and correct modified profile MFP.

Advantageously but not necessarily, the step 18 of determining possible imperfections and/or the step of correcting these imperfections are carried out by the operator O of the automatic machine 1, who uses the interface device 15 of the automatic machine 1. In this way, the setting up of a movable operating member is much faster with respect to the cases of the known art in which the operator must mechanically work certain components of the automatic machine 1, must forward the problem to an engineer, in particular a programming office, or must independently attempt to set the motion profiles by performing numerous experimental tests (which causes a waste of time and material).

In some preferred non-limiting cases, the method provides, furthermore, the step of defining a tolerance window to limit the modification of the conversion parameter 50. In particular, the limits of this tolerance window are illustrated to the operator O, by means of the interface device 15, during the correction step of the conversion parameter 50. In detail, therefore, the conversion parameter 50 allows one to convert the modification of the motion profiles described so far into the modification of a parameter correlated to the article to be produced.

Advantageously but not necessarily, the step 18 of determining possible imperfections is repeated following the step 19 of correcting the motion profile FP (more precisely following the step 21 of modifying the control of the electric actuator system 9). In particular, once the step 19 of correcting the profile FP has been carried out, a step 27 of analysing is carried out following which, if the motion profile MFP carried out by the movable operating member (for example by the pusher 7) is satisfactory (such as in FIG. 3 as it accompanies the packet 3 inside the seat 6 in its entirety), step 30 (in which the manufacturing of the packets 3 proceeds) is carried out, while if the profile MFP is not satisfactory (the pusher 7 does not push the packet 3 accurately inside the seat 6), steps 18, 19 and 27 are repeated iteratively until the desired operation is achieved by the movable operating member being set up.

Advantageously but not necessarily, the motion profile FP and the corresponding motion profile SP comprise at least one work phase WP (the movable operating member moves) and at least one recovery phase RP (the movable operating member is still), during which the step 21 of modifying the control takes place. In this way, the correction of the control that modifies the profile FP in the profile MFP avoids disturbing the movement of the electric actuator system 9 (namely, of the motor M).

Advantageously but not necessarily, the method comprises a step 22 of identifying one or more centres K (knots) of the motion profile FP. At least part of these centres can be modified by varying the conversion parameter 50 by means of the interface device 15, more precisely by the operator O.

In particular, during the step of correlating the profile FP with at least one conversion parameter 50, a mathematical law is defined which links the conversion parameter 50 to the centres K. More in particular, therefore, the step 19 of correcting the profile FP is carried out by modifying the value of the conversion parameter 50, which determines a variation, according to the aforementioned correlation, of the position of the movable operating member at the centres K.

According to some non-limiting embodiments, such as the one illustrated in FIG. 6, the motion profile FP comprises at least one linear function segment LF.

Alternatively, or in addition, the motion profile FP comprises at least one polynomial function segment PF (for example a polynomial of order greater than or equal to the fifth, a B-Spline of order greater than or equal to the third, . . . ). In particular, the centres K are the inflection points or the junction points of these function segments LF and PF.

Advantageously but not necessarily, the method comprises a step 23 of defining a tolerance interval I to limit the modification of each centre K. According to some non-limiting embodiments, such as the one illustrated in FIG. 6, the tolerance interval I is linear and comprises an upper limit UL and a lower limit LL along the ordinate axis (last follower operating member). The interval I (therefore the limits UL and LL) is chosen in order to respect the boundary conditions imposed by the system, so as to avoid mechanical collisions or risks for the automatic machine 1 and/or the operator O. According to other embodiments which are not limiting and not illustrated, the tolerance interval I is linear and comprises an upper limit UL and a lower limit LL along the abscissa axis (reference). The interval I (therefore the limits UL and LL) is chosen in order to respect the boundary conditions imposed by the system, so as to avoid mechanical collisions or risks for the automatic machine 1 and/or the operator O.

According to some further and non-limiting embodiments not illustrated, the tolerance interval I has a circular shape, the centre of which is a centre K.

Advantageously but not necessarily, before the step 20 during which the reverse kinematics is calculated, the control unit 14 checks (in the step 24 of FIG. 6) that all the centres K of the motion profile FP of the movable operating member are, each, within the respective tolerance interval I. In the event that centres K are outside the interval I, from step 24 one goes back to step 19 so that it is possible to enter a value comprised in the tolerance interval I.

Advantageously but not necessarily, the method comprises a step 25 of gathering a plurality of data items (for example, which variables have been modified and how big the modification is) concerning step 19 of correcting the motion profile FP. In particular, plural data items are used to carry out corrections on the motion profile FP during the design phase of the machine 1 and/or to understand possible calculation errors. In this way, it is possible to identify any errors due to the purchase of mechanical parts, design or calculation errors of the motion profiles FPS. In this way it is also possible to keep track of the modifications made to each automatic machine both during the set-up step and with the passing of time and with increasing wear of the components.

In some advantageous and non-limiting cases, the plurality of gathered data items are used to train artificial intelligence systems. In particular, the plurality of gathered data items is analysed by means of decision tree algorithms to identify, in the case of similar corrections on a plurality of automatic machines 1 with similar parts, possible improvements to be implemented directly during the design phase.

According to some non-limiting embodiments, the step 21 of modifying the control takes place while the automatic machine 1 is still. In this way, it is possible to ensure greater safety for the operator O, who, following each modification, checks the effectiveness of the same.

According to other non-limiting embodiments, the step 21 of modifying the control takes place while the automatic machine 1 is moving. In this way, it is possible to speed up the set-up of the movable operating member (for example the pusher 7).

Advantageously but not necessarily, the motion profile FP and the motion SP profile have a cam relation with a master profile MP. The terminology "have a cam relation" we mean that the motion profiles FP and SP are connected to a reference profile (the master profile MP) with a variable ratio from moment to moment. In other words, with this terminology we mean, for example, that for each position of the master profile MP a position of the movable operating member (the pusher 7), is respectively defined (and therefore, unrelated to the electric actuator system 9). Therefore, the master profile MP is related, by points, to the motion profile FP of the movable operating member. This relationship is useful for maintaining the synchronism of all the movable operating members of the automatic machine, which, being connected directly or indirectly to the same master axis, follow the latter in a coordinated way not only at steady state, but also in the acceleration and deceleration steps of the automatic machine 1, in particular at the start and at the end of the production of the articles.

In some non-limiting cases, the master profile MP is the profile of a physical axis, such as a sprocket or wheel. In some non-limiting cases, the master profile MP is the profile of a virtual axis.

In FIG. 6, the abscissa axis corresponds to the position of the master profile MP and the ordinate axis corresponds to the position of the last follower, or of the movable operating member, for example the pusher 7. In particular, the abscissa axis has values expressed in degrees, where a round angle (360°) corresponds to a machine cycle, while the ordinate axis is expressed in mm. Therefore, in the non-limiting embodiment of FIG. 6, the profiles FP and MFP indicate the position in mm of the pusher 7 along the stroke S.

Figure 7:
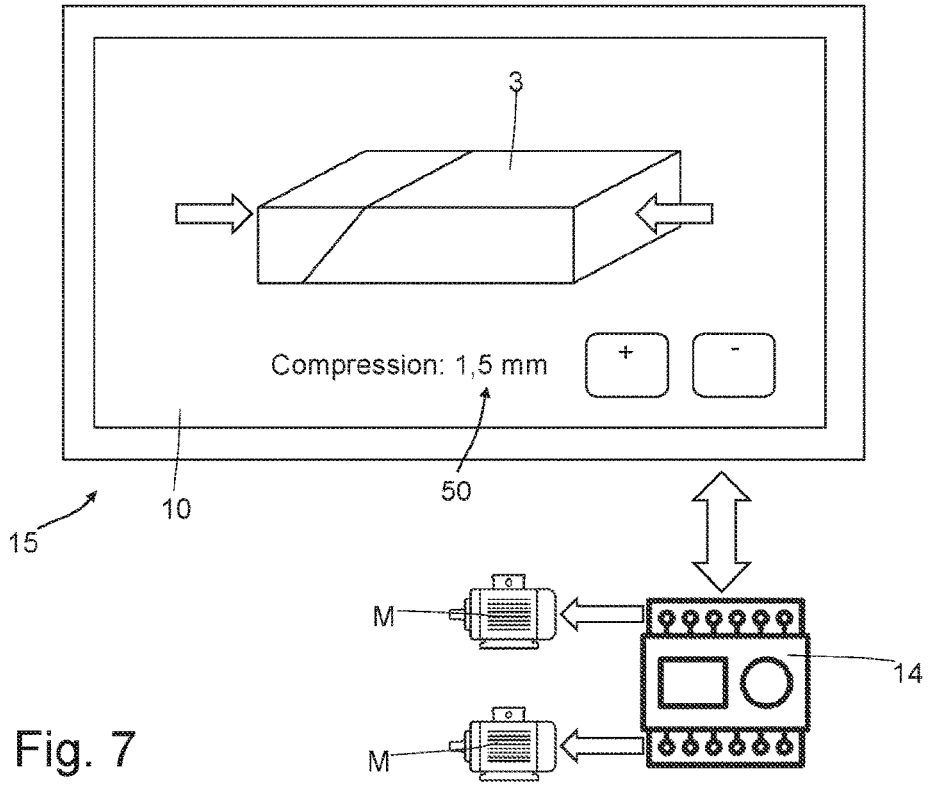
FIG. 7 schematically illustrates a possible screen display of an interface of the automatic machine concerning a unit configured to compress an article, for example the one of FIG. 2.

Advantageously and as illustrated in the non-limiting embodiment of FIG. 7, the interface device 15 allows the conversion parameter 50 to be varied in a controlled manner (for example with the + and − keys or by displaying the limits of the tolerance window). In this case, the conversion parameter 50 is the compression of the packet 3 (preferably but not necessarily illustrated by the interface device 15 so as to facilitate a possible operator O), according to which the control unit 14 (by means of calculation unit 26) re-processes the motion profiles MFP and MSP and controls the respective motors M which move the movable operating member 5, 7, 7'.

Advantageously but not necessarily, the correction of a conversion parameter 50 determines, in the case of multiple operating members 5, 7, 7' to carry out a single function, the variation of a plurality of motion profiles FPS.

Figure 8:
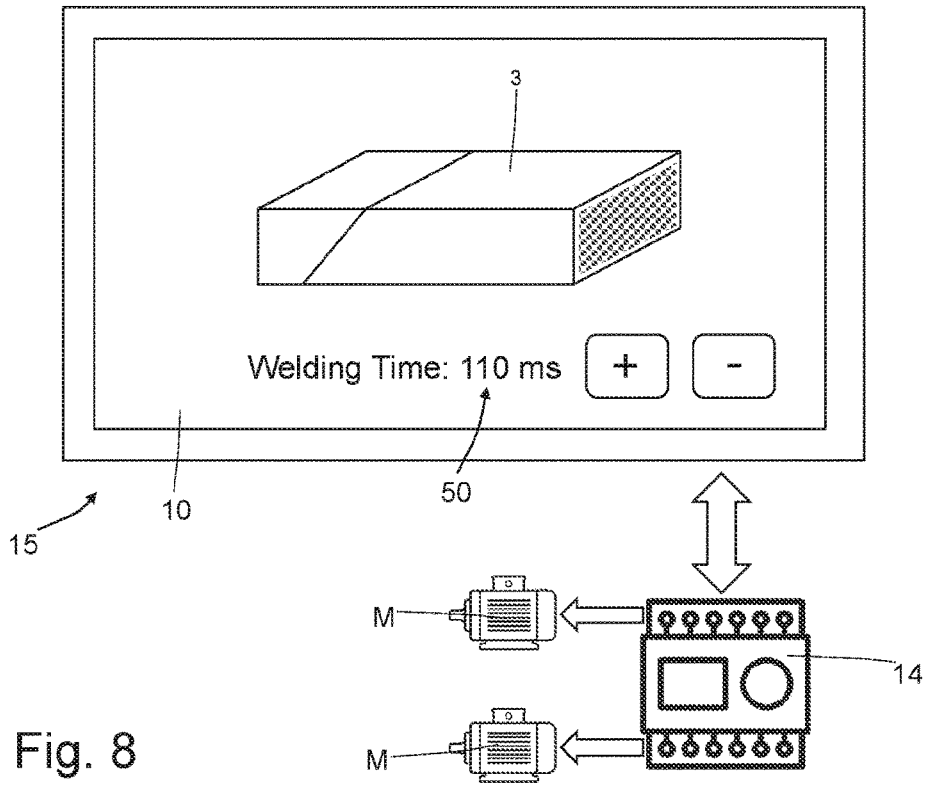
FIG. 8 schematically illustrates a possible screen display of an interface of the automatic machine concerning a unit configured to perform a timed operation, for example a sealing, on an article.

In the non-limiting embodiment of FIG. 8, the interface device 15 allows the conversion parameter 50 to be varied in a controlled manner (for example with the + and − keys or by displaying the limits of the tolerance window). In this case, the conversion parameter 50 is a sealing time for closing the package of the packet 3 (preferably but not necessarily illustrated by the interface device 15 in order to facilitate the understanding of a possible operator O), according to which the control unit 14 (through the calculation unit 26) re-processes the motion profiles MFP and MSP and controls the respective motors M which move the movable operating member 5, 7, 7'. In particular, in this case, by increasing or decreasing the value of the conversion parameter 50, the modified motion profile MFP will result in having an increased or decreased portion respectively in which a movable and sealing operating member (not illustrated) is in contact with the packet 3.

According to some non-limiting embodiments, the master profile MP is a linear profile. In particular, at steady state, the master profile MP is a motion profile whose speed is constant.

According to some non-limiting embodiments, as the one illustrated in FIG. 6, the motion profile FP and the motion profile SP are position profiles.

According to some non-limiting and not illustrated embodiments, the motion profile FP and the motion profile SP are speed profiles.

Alternatively, or in addition, the motion profile FP and the SP motion profile determine torque profiles.

In some non-limiting cases, such as for example the embodiment of FIG. 8, the master profile MP is time. For example, in these cases, the motion profiles FP, SP, MFP and MSP are speed profiles.

Advantageously but not necessarily, the motion profile FP is divided into several subsections, which are divided by centres K. In particular, in the event that the format of the article to be processed is the conversion parameter 50, at least one of these subsections is scaled according to the format set and the others are interpolated accordingly.

In use, the operator O, once having determined imperfections in the processing of the articles (for example, once having determined a stroke S that is too short, a compression that is too light or an excessive/insufficient sealing), interacts with the control unit 14, by means of the interface device 15 correcting the respective conversion parameter 50, so as to modify the position of the centres K and therefore the shape of the motion profile FP. In the non-limiting embodiment of FIG. 6, the operator O modifies the position of the centres K by setting that the position of the pusher corresponding to the positions of the master profile from 180° to 220° must be advanced by 3 mm (therefore the position of the pusher goes from 59 mm provided for the motion profile FP to 62 mm for the motion profile MFP). However, to directly modify the centres K, the operator O requires additional skills compared to the common ones. On the other hand, in the non-limiting embodiments of FIGS. 7 and 8, the operator O exclusively modifies the conversion parameter 50 (which is relative to the product and/or to an effect that is to be obtained on the product itself). In this way, the operator O, indirectly and completely unaware of the technicalities underlying the correlation between the conversion parameter 50 and the relative motion profile FP, modifies the motion profile FP, thus determining the modified profile MFP. Once this step is completed, the calculation unit 26 processes the corresponding modified profile MSP of the motor M of the electric actuator system 9 (which in FIG. 6 is illustrated by way of example and not in the same scale as the profile FP). In particular, it should be noted that advantageously but not necessarily, the operator O can only modify certain conversion parameters 50, specially set up during the design phase, so as to avoid the modification of parameters that would compromise the safety of the machine 1 or of the operator O (for example for possible mechanical collisions).

Advantageously but not necessarily, the interface device 15 allows, in an additional and/or alternative way, the modification of the conversion parameter 50, modification also of part of the centres K (for example those comprised in the blocks 34 and whose ordinate can be modified in any case ensuring the correct functioning of the automatic machine 1), while it does not allow the modification of the values contained in the blocks 35, which represent constraints necessary for the correct processing of the articles.

Advantageously but not necessarily, the automatic machine 1 is configured to carry out the method described up to now.

Although the invention described above makes particular reference to a very precise embodiment, it is not to be considered limited to this embodiment, as it comprises all those alternatives, modifications or simplifications that would be evident to those skilled in the art, such as for example: the addition of additional actuators, another type of automatic machine other than a packaging machine for the tobacco industry, a different shape of the motion profiles, a different order of the phases of the method, a different number of motors, a different type of conversion parameters, etc.

The present invention has multiple advantages.

First of all, it allows one to set up a movable operating member directly on site and in a short time, without the waste of materials, such as shims, and the use of tools, such as drills, cutters, files, etc.

Furthermore, the method described above makes it possible to detect and calculate the difference between different automatic machines which are substantially similar, but which undergo different adjustments due to assembly and/or structural defects of the available parts.

Lastly, the present invention makes it possible to record and share a plurality of data items concerning the set up of the movable operating members and therefore, it allows to understand, at a distance and/or with the aid of digital systems, whether there have been errors in the machine design and possibly solve said errors.

Further advantages linked to the process according to the present invention relate to the improvement of the after-sales support. For example, a machine operator, if a movable operating member gradually wears out, can autonomously modify its motion profile based on what is seen or detected and therefore, the present invention avoids the immediate replacement of parts of the automatic machine and/or having to continually send experienced personnel to customers.

The invention claimed is:

1. A method to set up at least one movable operating member (5, 7, 7') of an automatic machine (1) for manufacturing consumer articles (3), the method comprising the steps of:

defining a first motion profile (FP) of the at least one movable operating member (5, 7, 7'), through which at least one processing of the articles (3) is to be carried out;

correlating the first motion profile (FP) of the at least one movable operating member (5, 7, 7') with at least one conversion parameter (50) concerning the articles (3) to be manufactured;

defining a corresponding second motion profile (SP) of an electric actuator system (8, 9), which, through a motion transmission system (12), is mechanically connected to the at least one movable operating member (5, 7, 7') and moves the at least one movable operating member (5, 7, 7') with the first motion profile (FP);

detecting possible imperfections in the at least one processing of the articles (3) by the at least one movable operating member (5, 7, 7');

correcting, by means of an interface device (15) of the automatic machine (1) and based on said detected possible imperfections, the at least one conversion parameter (50) concerning the articles (3);

processing, by means of a control unit (14) and depending on the correction of the at least one conversion parameter (50), the first motion profile (FP), thus obtaining a first modified profile (MFP) of the at least one movable operating member (5, 7, 7');

calculating, by means of the control unit (14), a reverse kinematics of the first modified profile (MFP) of the at least one movable operating member (5, 7, 7') through the motion transmission system (12) so as to obtain a corresponding second modified profile (MSP) to be commanded to the electric actuator system (8, 9); and modifying control of the electric actuator system (8, 9) so as to carry out the corresponding second modified profile (MSP).

2. The method according to claim 1, wherein the at least one conversion parameter (50) comprises a position, a compression of the articles (3), or a time.

3. The method according to claim 1, wherein the at least one conversion parameter (50) comprises a format of the articles (3) being processed.

4. The method according to claim 1, wherein the step of detecting possible imperfections and/or the step of correcting the at least one conversion parameter (50) are/is carried out by a machine operator (O) who uses the interface device (15) of the automatic machine (1).

5. The method according to claim 1, wherein the first motion profile (FP) and the corresponding second motion profile (SP) comprise at least one work phase (WP) and at least one recovery phase (RP) during which the step of modifying control of the electric actuator system takes place.

6. The method according to claim 1, further comprising the step of defining a tolerance window to limit modification of the at least one conversion parameter (50).

7. The method according to claim 1, further comprising the step of identifying one or more centers (K) of a first motion profile (FP), a position of said one or more centers (K) being modified by the correction of the at least one conversion parameter (50) by means of the interface device (15).

8. The method according to claim 7, wherein the first motion profile (FP) comprises at least one linear function segment (LF) and/or at at least one polynomial function segment (PF) and said one or more centers (K) are inflection points or junction points of said at least one linear function segment (LF) and/or said at least one polynomial function segment (PF).

9. The method according to claim 7, further comprising the step of defining a tolerance interval (I) to limit the modification of each center (K) corresponding to a tolerance window of the at least one conversion parameter (50).

10. The method according to claim 9, wherein, before calculating the reverse kinematics, the control unit (14) checks whether the one or more centers (K) of the first motion profile (FP) of the at least one movable operating member (5, 7, 7') are each within the respective tolerance interval (I).

11. The method according to claim 1, further comprising the step of gathering a plurality of data items concerning the step of correcting the at least one conversion parameter (50).

12. The method according to claim 1, wherein the step of modifying control of the electric actuator system takes place while the automatic machine (1) is still or while the automatic machine (1) is moving.

13. The method according to claim 1, wherein the first motion profile (FP) and the second motion profile (SP) have a cam relation with a master profile (MP).

14. The method according to claim 13, wherein the master profile (MP) is linear.

15. The method of claim 9, wherein the tolerance interval (I) comprises an upper limit (UL) and a lower limit (IL).

16. The method of claim 11, wherein the plurality of data items are used to carry out corrections of the first motion profile (FP) during designing of the automatic machine (1) and/or to understand possible calculation errors.

17. The method of claim 11, wherein the plurality of gathered data items are used to train artificial intelligence systems.

18. The method of claim 13, wherein the master profile (MP) is a profile of a physical or virtual axis.

19. The method of claim 14, wherein the master profile (MP) is time.

20. An automatic machine (1) for manufacturing consumer articles (3), the automatic machine (1) comprising at least one electric actuator system (8, 9), a motion transmission system (12), a movable operating member (5, 7, 7'), a control unit (14);

which is configured to control the at least one electric actuator system, and an interface device (15) which is configured to allow a machine operator (O) to modify motion of the at least one movable operating member (5, 7, 7'), the automatic machine (1) being configured to carry out the method according to claim 1.

* * * * *